US008387822B2

(12) United States Patent
Antal, Sr. et al.

(10) Patent No.: US 8,387,822 B2
(45) Date of Patent: Mar. 5, 2013

(54) SEALING LID FOR A CONTAINER

(75) Inventors: Keith E. Antal, Sr., Valatie, NY (US); Chad Lagace, Cohoes, NY (US); Michael Tucker, Valatie, NY (US); Thomas Rigney, Valatie, NY (US); Fedor Baranov, East Greenbush, NY (US); Thomas Hocker, Albany, NY (US)

(73) Assignee: Sonoco Development, Inc., Hartsville, SC (US)

( * ) Notice: Subject to any disclaimer, the term of this patent is extended or adjusted under 35 U.S.C. 154(b) by 293 days.

(21) Appl. No.: 12/832,695

(22) Filed: Jul. 8, 2010

(65) Prior Publication Data

US 2012/0006824 A1 Jan. 12, 2012

(51) Int. Cl.
*B65D 41/18* (2006.01)

(52) U.S. Cl. ..... 220/786; 220/326; 220/784; 215/321

(58) Field of Classification Search ..... 220/315, 220/324, 326, 784, 786, 788, 320, 321; 215/317, 215/321, 274, 277

See application file for complete search history.

(56) References Cited

U.S. PATENT DOCUMENTS

| | | | | |
|---|---|---|---|---|
| 3,028,993 | A | | 4/1962 | Muhlhoff |
| 3,080,993 | A | | 3/1963 | Livingstone |
| 3,178,051 | A | | 4/1965 | Edwards |
| 3,244,308 | A | | 4/1966 | Esposito, Jr. |
| 3,380,610 | A | | 4/1968 | Krieps |
| 3,381,872 | A | | 5/1968 | Holder et al. |
| 3,471,054 | A | | 10/1969 | Ostrowsky et al. |
| 3,532,244 | A | * | 10/1970 | Yates, Jr. ..... 215/272 |
| 3,546,752 | A | * | 12/1970 | Sargent ..... 220/324 |
| 3,559,843 | A | | 2/1971 | Kern |
| 3,688,942 | A | * | 9/1972 | Mitchell et al. ..... 220/784 |
| 3,817,419 | A | * | 6/1974 | Moller et al. ..... 220/315 |
| 4,135,657 | A | | 1/1979 | Benson et al. |
| 4,154,360 | A | | 5/1979 | Smith |
| 4,194,772 | A | | 3/1980 | Hurd et al. |
| 4,279,358 | A | * | 7/1981 | Jacobs ..... 220/321 |
| 4,377,245 | A | * | 3/1983 | Patty ..... 220/822 |
| 4,591,055 | A | | 5/1986 | Corn |
| 4,718,571 | A | | 1/1988 | Bordner |
| 4,741,453 | A | * | 5/1988 | Stolzman ..... 220/315 |
| 4,917,261 | A | * | 4/1990 | Borst ..... 220/324 |
| 4,932,554 | A | | 6/1990 | Smith et al. |
| 4,951,833 | A | | 8/1990 | Carpenter, Jr. et al. |
| 5,302,791 | A | | 4/1994 | Meyers et al. |
| 5,551,191 | A | | 9/1996 | Maiwandi |

(Continued)

*Primary Examiner* — Anthony Stashick
*Assistant Examiner* — James N Smalley
(74) *Attorney, Agent, or Firm* — Flaster/Greenberg PC

(57) ABSTRACT

A lid is provided for engagement with a projecting rim of an opening on a container. The lid includes a covering panel for closing the container opening and a skirt formed on a periphery of the cover and depending therefrom. The skirt overlaps with the container rim when the cover is positioned over the opening. The skirt includes a defined gap therein that is positioned between adjacent gap edges. A clasp is provided on the periphery of the cover adjacent the defined gap. The clasp pivots between an open position and an engaged position. In the engaged position, the clasp engages the gap edges and draws the edges toward one another. The drawing of the gap edges moves the skirt inwardly towards the container rim. The lid may further include a flexing portion defining a connection between the cover panel and the skirt. The engagement of the clasp on the skirt causes compliance of the flexing portion and a corresponding axial movement of the skirt relative to the cover panel.

29 Claims, 5 Drawing Sheets

U.S. PATENT DOCUMENTS

| | | | |
|---|---|---|---|
| 5,628,404 | A | 5/1997 | Hendrix |
| 5,641,065 | A | 6/1997 | Owens et al. |
| 5,785,196 | A | 7/1998 | Montgomery |
| 5,865,335 | A | 2/1999 | Farrell et al. |
| 5,921,432 | A | 7/1999 | Van Berne et al. |
| 5,979,690 | A | 11/1999 | Hartley |
| 6,074,677 | A | 6/2000 | Croft |
| 6,196,451 | B1 | 3/2001 | Helms |
| 6,364,152 | B1 | 4/2002 | Poslinski et al. |
| 6,581,795 | B1 | 6/2003 | Schülein et al. |
| D483,622 | S | 12/2003 | Kim |
| 6,763,960 | B2 | 7/2004 | Oh |
| 6,779,692 | B2 | 8/2004 | Dopp et al. |
| 6,793,096 | B1 | 9/2004 | Seok |
| D499,931 | S | 12/2004 | Kim |
| D500,227 | S | 12/2004 | Seok |
| D523,296 | S | 6/2006 | Kim |
| 7,090,089 | B2 | 8/2006 | Lown et al. |
| D527,633 | S | 9/2006 | Stull et al. |
| 7,169,418 | B2 | 1/2007 | Dalton et al. |
| D556,517 | S | 12/2007 | Lown et al. |
| 7,311,218 | B2 | 12/2007 | Varadarajan |
| D562,083 | S | 2/2008 | Lown et al. |
| D564,878 | S | 3/2008 | Baughman et al. |
| D575,115 | S | 8/2008 | Zimmerman |
| 7,475,789 | B2 | 1/2009 | Fischer |
| D590,666 | S | 4/2009 | Wang |
| D591,112 | S | 4/2009 | Wang |
| D604,119 | S | 11/2009 | Kim |
| 2004/0084464 | A1 | 5/2004 | Koo |
| 2004/0195241 | A1 | 10/2004 | Stull et al. |
| 2004/0206766 | A1 | 10/2004 | Law |
| 2004/0256348 | A1 | 12/2004 | Stevens et al. |
| 2005/0035125 | A1 | 2/2005 | Bae |
| 2005/0045577 | A1 | 3/2005 | Lown et al. |
| 2005/0145627 | A1 | 7/2005 | Stull et al. |
| 2006/0124643 | A1 | 6/2006 | Markert et al. |
| 2006/0151509 | A1 | 7/2006 | Eiskant et al. |
| 2007/0251948 | A1 | 11/2007 | Baker |
| 2008/0011879 | A1 | 1/2008 | Gerson et al. |
| 2008/0105684 | A1 | 5/2008 | Lindsay |
| 2008/0169287 | A1 | 7/2008 | Auer et al. |
| 2008/0217338 | A1 | 9/2008 | Campbell et al. |
| 2009/0008284 | A1 | 1/2009 | Lown et al. |
| 2009/0011631 | A1 | 1/2009 | Yoo |
| 2009/0020545 | A1 | 1/2009 | Meyer |
| 2009/0020721 | A1 | 1/2009 | Ohmi et al. |
| 2009/0078715 | A1* | 3/2009 | Kim ..... 220/782 |
| 2009/0110777 | A1 | 4/2009 | Buisson |
| 2009/0114650 | A1 | 5/2009 | Houston, Jr. et al. |
| 2009/0218360 | A1 | 9/2009 | Suk |
| 2009/0223967 | A1 | 9/2009 | Mengeu et al. |
| 2009/0232947 | A1 | 9/2009 | Buisson et al. |

* cited by examiner

SEALING LID FOR A CONTAINER

FIELD OF THE INVENTION

The present invention relates to a lid, overcap or similar closure to be applied to a container, with the lid including structural elements to secure the lid to the container opening.

BACKGROUND OF THE INVENTION

A number of forms of lids and closures are known for covering the open end of a container and for selectively controlling the discharge of material from the container.

U.S. Pat. No. 3,028,993 to Muhlhoff shows a securing ring for locking a lid onto a container rim. The ring is locked into a securing position on the rim by a latch. The ring includes a plurality of retention flanges that overlap the rim of the container and engage the top and bottom sides of the rim and the edge of the lid.

U.S. Pat. No. 7,090,089 to Lown et al shows a combination container and sealing lid. The skirt portion of the lid includes a pair of rotatably mounted latches having protruding hooks thereon. Rotation of the latches into engagement with the rim of the container causes the hooks to secure the cover onto the rim.

U.S. Pat. No. 4,135,657 to Benson et al shows a locking ring assembly for a container. The ring is locked into a securing position on the rim by a latch. The ring includes an inwardly projected U-shaped channel that wraps around the outside of the rim of the container to secure the edge of the lid to the rim.

U.S. Ser. No. 2004/0256348 to Stevens et al shows an overcap or lid for a container having a circular hinged portion positioned between the rim engaging portion and the central planer portion. The rim engaging portion includes an inner skirt having a normal outside diameter that fits inside the wall of the container and an outer skirt that fits outside the container rim. Forcing the central planer portion of the lid downwardly into the container causes the circular hinged portion to flex and to push the skirt into a sealing engagement with the inside wall of the container.

U.S. Pat. No. 5,865,335 to Farrell et al shows in one embodiment a rim engaging ring having a removable tear strip portion that joins the peripheral skirt and the central wall of the lid. The tear strip is defined by two annular score lines in the wall of the lid.

U.S. Pat. No. 3,380,610 to Krieps shows a container lid having a peripheral skirt that fits over the rim of the container, sealing both to the inside and outside surfaces. Forcing a central portion of the lid downwardly, into the container, causes an extension flap on the central portion to flex or pivot into an inside sealing engagement with a groove formed on the inside wall of the container.

U.S. Pat. No. 5,979,690 to Hartley shows a peripheral skirt on a container rim having a tear-off strip formed between opposing engagement tabs. The tear-off strip initially extends downwardly from the upper rim engaging portion of the lid. The strip includes a locking groove that engages a locking lip formed on the outside surface of the container rim. When the strip is removed, the engagement tabs remain attached to the lid. The tabs can be flipped upwardly to release the lid from the rim of the container.

SUMMARY OF THE INVENTION

A lid for a container is defined for engagement with a projecting rim of an opening on the container. The lid includes a cover for covering at least a portion of the container opening and a skirt formed on a periphery of the cover and depending therefrom. The skirt is formed to overlap the container rim when the cover portion is positioned over the container opening. The skirt includes a defined gap therein that is positioned between adjacent gap edges. A clasp is provided on the periphery of the cover adjacent the defined gap in the skirt. The clasp pivots between an open position and an engaged position. In the engaged position, the clasp engages the gap edges and draws the edges toward one another, shortening the gap, and moving the skirt inwardly towards the container rim.

The lid may include a projection formed on an inside surface of the skirt. The projection is directed toward the container rim when the lid is positioned on the container opening. A corresponding bead may be formed on the rim of the container opening, wherein the skirt projection engages the rim bead to secure the lid to the container in the engaged position of the clasp. The lid may further include a flexing portion defining a connection between the cover portion and the skirt. The flexing portion is compliant relative to the surrounding structures of the skirt and the cover, such that the skirt may move axially relative to the cover. The engagement of the clasp on the skirt preferably causes an inward movement of the skirt. The skirt projection may move axially under the rim bead to engage and seal the lid to the rim of the container.

Other features of the present invention will become apparent from the detailed description to follow, taken in conjunction with the accompanying drawings.

BRIEF DESCRIPTION OF THE DRAWINGS

For the purpose of illustrating the invention, the drawings show forms that are presently preferred. It should be understood that the invention is not limited to the precise arrangements and instrumentalities shown in the drawings.

DETAILED DESCRIPTION

Figure 1:
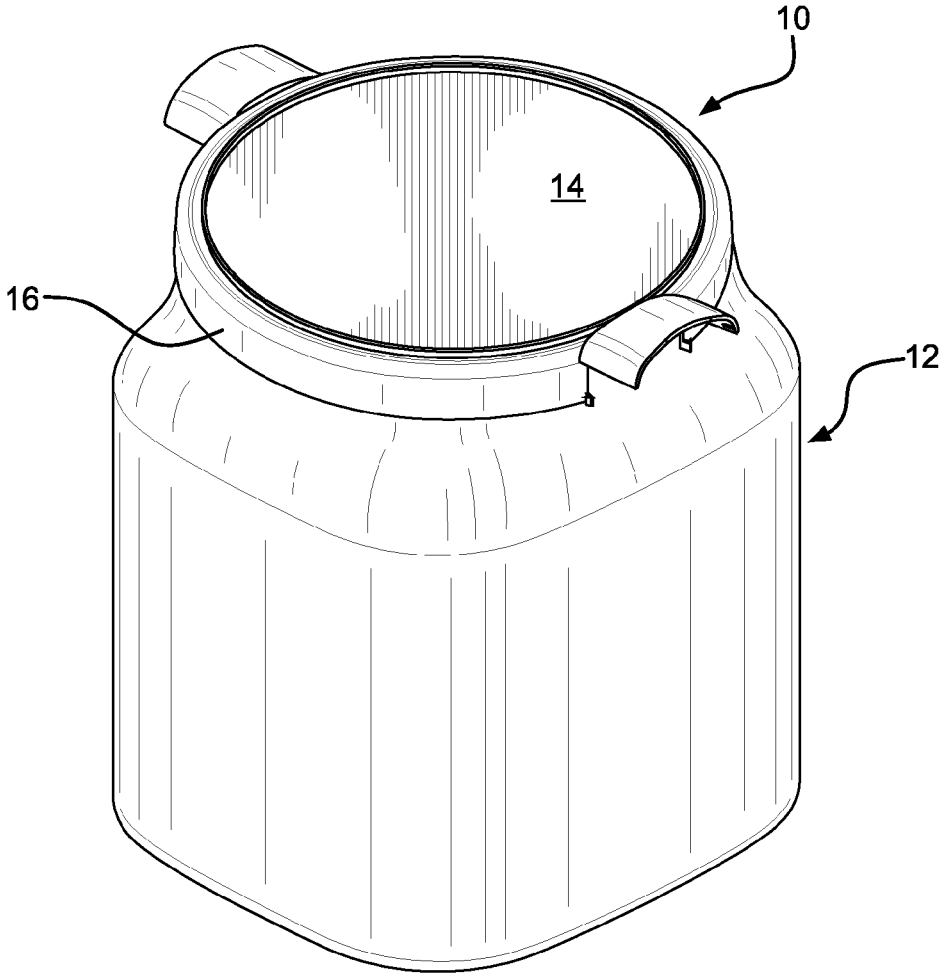
FIG. 1 shows a perspective view of a container having thereon an embodiment of a lid as contemplated by the present invention.
Figure 2:
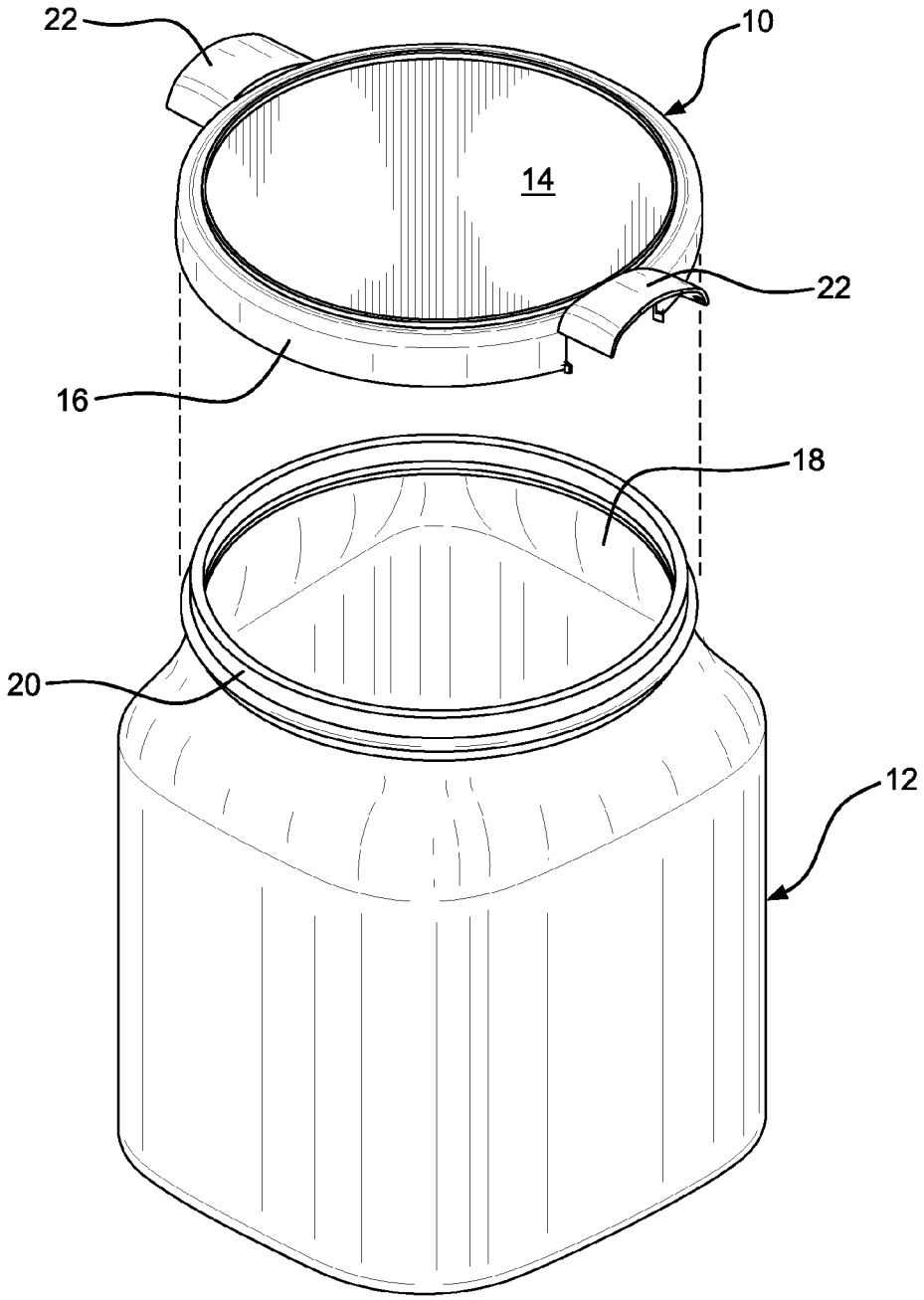
FIG. 2 shows an exploded perspective view of the container and lid combination of FIG. 1.

In the figures, where like numerals identify like elements, there is shown an embodiments of a lid, overcap or closure for a container or the like. In FIGS. 1 and 2, the lid is generally identified by the numeral 10 and is positioned on the container generally identified by the numeral 12. The lid 10 includes a cover panel portion 14 and a peripheral skirt 16. The cover panel 14 fits over the top end of the container 12. The skirt 16 depends from the cover portion 14 and overlaps the top of the container 12. As seen in the exploded view of FIG. 2, the top end of the container 12 includes an opening 18, providing access to the interior storage volume of the container. The opening 18 is defined by an annular rim 20. In the position shown in FIG. 1, the cover portion 14 of the lid 10 fits over the opening 18 of the container 12 and the skirt 16 overlaps and surrounds the rim 20. The cover portion 14 covers at least a portion of the container opening 18 and preferably completely closes the opening 18, sealing the contents (not shown) within the storage volume of the container 12.

The lid 10 as shown includes a pair of pivoting clasps 22. Preferably, the clasps 22 are integrally formed with the cover portion 14 and skirt 16. As more particularly illustrated in FIGS. 3 and 4, the clasp 22 is attached to the cover 14 at a position closely adjacent the top of the skirt 16. The clasp 22 is preferably connected to the cover 14 by a living hinge 24 or the like. This hinged arrangement permits the clasp 22 to pivot from an open position (FIG. 3) to a closed or engaged position (FIG. 4). The clasp 22 is formed adjacent a defined gap 26 in the skirt 14. The gap 26 is a break in the skirt material and is defined by two gap edges 28, 30. The gap edges 28, 30 are preferably formed parallel to one another and are substantially perpendicular to the plane of the cover portion 14.

Figure 3:
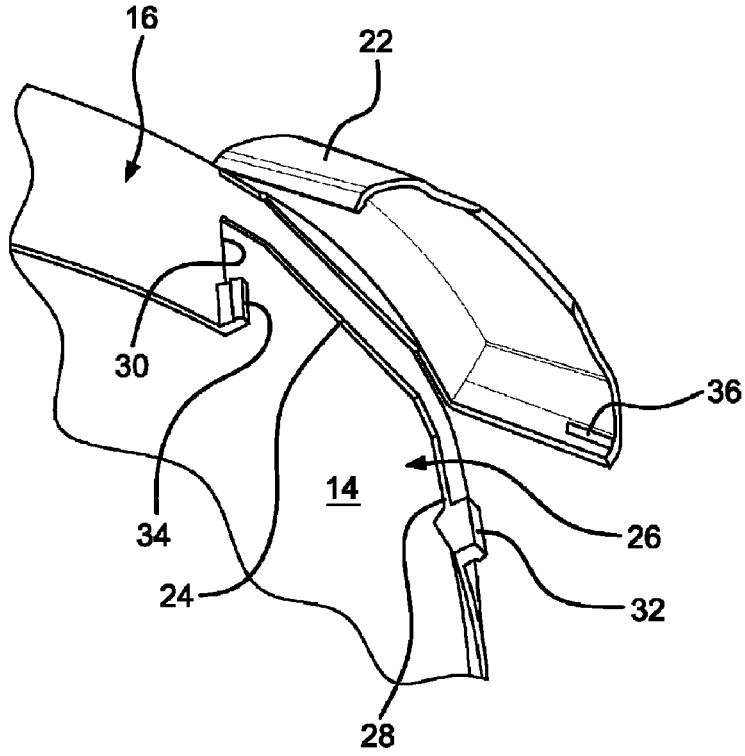
FIG. 3 shows a partial view of the lid of FIGS. 1 and 2 with a clasp portion in an open position.
Figure 4:
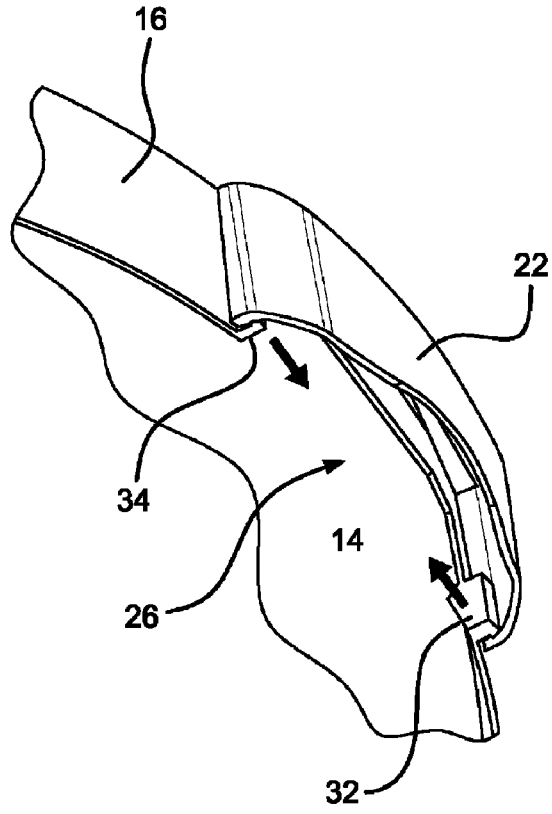
FIG. 4 shows a partial view of the clasp portion of FIG. 3 in an engaged position.

As shown in FIG. 3, locking elements in the form of tabs 32, 34 are respectively formed on the gap edges 28, 30. The locking tabs 32, 34 project outwardly from the skirt 14 and form hooks for engagement of the ends of the clasp 22. Engagement slots 35 (only one shown in FIG. 3) are formed on the inside surfaces of the ends of the clasp 22 for receipt of the hooks on the ends of the tabs 32, 34. In the engaged position (FIG. 4), the clasp 22 is fit over the defined gap 26 in the skirt 16 and the hooks on tabs 32, 34 engage the slots 35 to lock the clasp to the skirt 16 on each side of the gap 26. Preferably, the resilience of the materials used and the dimensional relationship between the defined gap 26 and the clasp 22 results in a circumferential pull on the skirt 16, illustrated by two arrows in FIG. 4. The pulling force across the gap 26 tends to reduce the size of the gap 26 and to move the skirt 14 inward, in a direction towards the rim 20 of the container 12.

Figure 5:
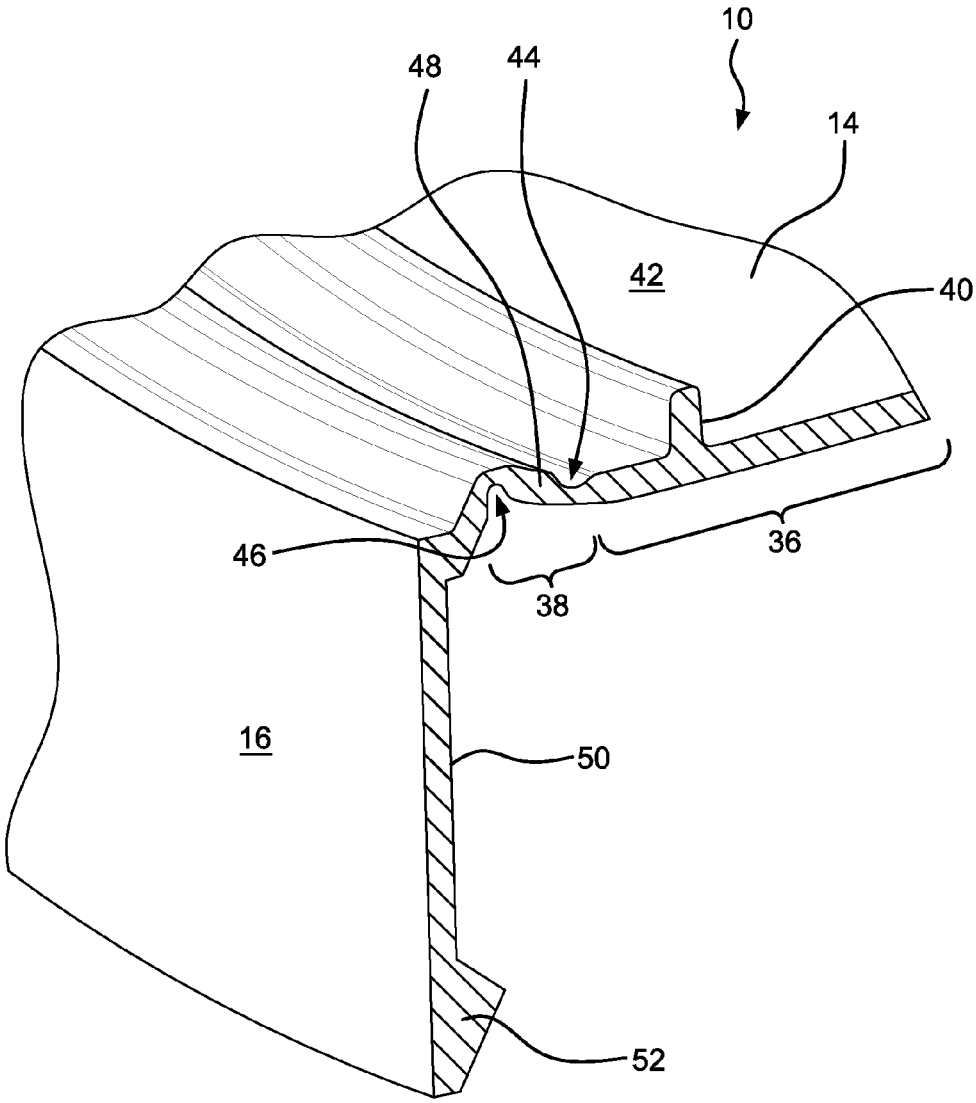
FIG. 5 shows a partial perspective view in cross section of the cover and skirt portions of the lid of FIGS. 1-5.

In FIG. 5, the lid 10 is shown in cross section. As illustrated, the cover portion 14 is defined by a substantially planer body portion 36 and a flexing portion 38 at its outer periphery. The flexing portion 38 connects the body 36 to the skirt 16. An upstanding ring 40 is provided on the upper surface 42 of the body 36. The ring 40 may be used to center adjacent lids when placed in a stacked position (not shown) or to center stacked containers by engagement of a corresponding recess (or the like) in the bottom surface of the container (also not shown), as is known in the art. The flexing portion 38 is defined by two grooves 44, 46, formed by a reduction in the wall thickness of the cover 14, and a connecting portion 48. Based on the materials selected and based on the relative thickness of the skirt 16, cover body 36 and connecting portion 48, the tension in the skirt 16 will cause a pivot of the connection portion 48 about inner groove 44, such that the skirt 16 will move axially away from the body 36. This structural compliance of the peripheral edge of the cover portion 14 creates an additional sealing motion within the skirt 16, as the clasps 22 are moved into the engaged position (FIG. 4) over the gap 26. In an alternative arrangement, or as an additional element of the flexing movement, the portion of the lid connecting the skirt (or a portion thereof) to the cover may be formed by a relatively compliant material that permits flexing and a corresponding structural movement of the skirt.

Figure 6:
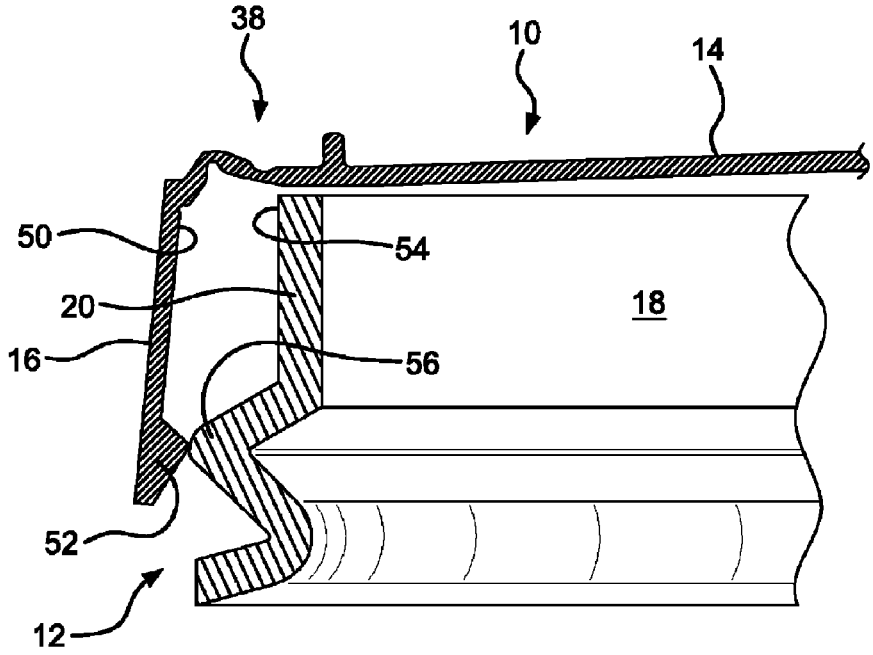
FIG. 6 shows a partial cross sectional view of the relationship between the lid and container in the open position of the clasp as in FIG. 3.
Figure 7:
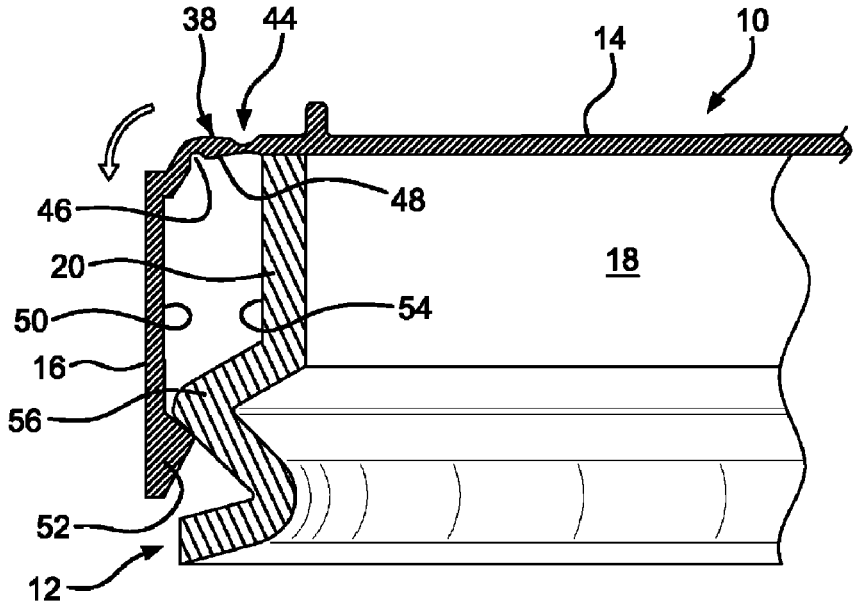
FIG. 7 shows a partial cross sectional view of the relationship between the lid and container in the engaged position of the clasp as in FIG. 4.

In FIGS. 6 and 7, there is shown the relationship between the lid 10 and the container 12 in the open position of the clasps 22 (FIG. 3) and the engaged position (FIG. 4). In FIG. 6, the cover 14 is positioned over the opening 18 of the container 12, with the skirt 16 overlapping the rim 20. The flexing portion 38 extends outwardly past the rim 20 with a space formed between the outside surface 54 of the rim 20 and the inside surface 50 of the skirt 16. As shown, a projection 52 in formed on the inside surface 50 of the skirt 16. The projection 52 may be continuous or intermittent along the length of the skirt 16. A bead 56 is also formed on the outside surface 54 of the rim 20 and is positioned approximately at the same level as the projection 52 on the overlapping skirt 16. In this open position (for the clasp), the lid 10 fits loosely on the container opening 18.

In FIG. 7 there is shown the reaction of the lid 10 to the engagement of the clasps 22 (as in FIG. 4). As discussed above, when the clasps 22 are moved into the engaged position, the defined gap 26 is shortened, bringing the skirt 16 portions inwardly. In addition, the flexing portion 38 rotates about the groove 44 at the connection to the body portion 36. This rotation or flexing permits the skirt 16 to move downwardly along the outside wall 54 of the rim 20. The downward movement of the skirt 16 moves the inside projection 52 past the bead 56 on the rim 20. In the engaged position, the projection 52 is located vertically under the bead 56 and the bottom surface of the body portion 14 of the cover 14 is in contact with the chime or top edge of the rim 20. Depending on the dimensional relationship between the elements, the engaged position of the clasps 22 (as in FIG. 4) creates a seal between the lid 10 and the rim 20 of the container 12. In addition, the engagement between the projection 52 on the skirt 16 and the bead 56 on the rim 20 locks the lid 10 to the container 12. Release of the clasps reverses the relative movements of the lid parts and unlocks the lid for easy removal.

If the clasps are integrally formed, manufacture of the lid 10 requires a mold that includes cavities for the clasps 22 in an open position. The connection between the clasp 22 and the cover portion 14 of the lid 10 is preferably formed as a living hinge. A two shot molding process may be used to form the hinge and a second, more compliant material may be used for the hinge. Further, the flexing portion 38 is preferably formed in a position that locates the projection 58 on the skirt 16 at a contact position when the lid 10 is placed in the rim 20 of the container 12. The cover portion 14 and skirt 16 may also be formed separate from the flexing portion 38 in a two shot molding process. The grooves 44, 46 (FIG. 5) provide a level of compliance as compared to the surrounding portions. The grooves are defined by a reduction in wall thickness as compared to the surrounding connection portion 48, cover body 36 and skirt 16. The material of the flexing portion 36 may also be different than the other portions of the lid to enhance compliance or to provide resiliency to the flex. The materials may include one or more thermoplastics or may alternatively include an elastomeric second material. Non-limiting examples of materials that may be used include various polyolefins (including homopolymers, co-polymers, etc.), polyester and others. Potential second materials include thermoplastic rubber, thermoplastic elastomers, etc.

In the drawings, the opening at the top of the container and the corresponding rim are shown as circular. Thus, the lid is generally circular to provide cover for the opening and for the skirt to engage the rim. Other shapes are possible and contemplated. For example, the opening may be oval, square or rectangular, with the lid matching the outline of the rim. Further, the opening on the container may be positioned at any number of locations on the container and is not limited to being flush with the top end. Any number of clasps may be defined within the rim. At least one is contemplated, with the defined gap serving to form a split in the engagement ring of the skirt. Preferably, a balancing of the sealing forces is provided and more easily results from an even number of gaps, with the clasps in a spaced relationship.

Preferably, the closing force created by the one or more clasps serves to reduce the circumference of the skirt and provides a sealing force against the rim of the container. The initial dimensions of the lid relative to the rim of the container may provide for retention of the lid on the rim, by means of a snap fit or the like. The form and dimensions of the parts may also provide an audible noise to identify completion of the engagement. In providing an engagement force within the skirt, the lid is preferably more firmly locked to the rim. Also, as shown in FIG. 7, the engagement preferably creates a sealing force between the lid cover portion and the rim of the container. This sealing force is the function of the reduction of the circumference of the skirt and may also result from the flexing of the edge connection between the cover and the skirt. As the skirt circumference is reduced in size, the inside projection on the skirt moves axially and wedges under the bead on the rim of the container. This wedging action preferably is combined with a flexing of the edge portion of the cover and causes a resilient sealing force by the lid on the rim. The rim engagement may define a seal sufficient to maintain the freshness of the contents of the container. In addition, the sealing engagement may be sufficiently resilient to provide pressure release from within the container for stored contents that experience off-gassing, such as coffee grounds.

The present invention has been described and illustrated with respect to a number of exemplary embodiments thereof. It should be understood by those skilled in the art from the foregoing that various other changes, omissions and additions may be made therein, without departing from the spirit and scope of the present invention, with the scope of the present invention being described by the foregoing claims.

What is claimed is:

1. A lid for engagement of a projecting rim formed on a container opening, the lid comprising:

a cover for covering at least a portion of the container opening, a skirt formed on a periphery of the cover portion and depending therefrom, the skirt formed to overlap and surround the container rim when the cover portion is positioned over the container opening, the skirt having a defined gap therein positioned between adjacent gap edges, and a clasp pivotably attached adjacent the cover and positioned for overlap of the defined gap, the clasp pivoting transversely with respect to the cover from an open position to an engaged position, the clasp extending outward from the pivot and spaced from the adjacent skirt portion in the open position, the clasp overlapping the defined gap in skirt and resiliently engaging the gap edges in the engaged position, the resilient engagement of the gap edges by the clasp drawing the edges toward one another to shorten the defined gap, wherein the drawing of the gap edges in the engaged position of the clasp moves the skirt inwardly towards the container rim.

2. The lid of claim 1 further comprising a projection formed on an inside surface of the skirt, wherein the projection is directed toward the container rim when the lid is positioned on the container opening.

3. The lid of claim 1 further comprising a flexing portion defining a connection between the cover and the skirt, at least a portion of the flexing portion being compliant relative to the surrounding portions of the skirt and the center panel.

4. The lid of claim 3 wherein the flexing portion permits axial movement of the skirt relative to the cover in response to the engagement of the clasp with the gap edges.

5. The lid of claim 4 further comprising a projection formed on an inside surface of the skirt, wherein the projection is directed toward the container rim when the lid is positioned on the container opening.

6. The lid of claim 5 wherein the inward projection is positioned to engage an outwardly projecting bead formed on an outer surface of the rim of a container and wherein the axial movement of the skirt created by the flexing positions the inward projection in an overlapping relation with the bead of the container rim.

7. The lid of claim 6 wherein the cover seals with the container rim in the engaged position of the clasp as a result of the inward and axial movement of the skirt.

8. The lid of claim 3 wherein the flexing portion is defined by a pair of spaced grooves in the wall of the cover, creating structural compliance.

9. The lid of claim 3 wherein the flexing portion is defined by a material that is relatively compliant as compared to the materials of the adjacent skirt and cover portions.

10. The lid of claim 1 wherein the clasp is integrally formed with the cover portion.

11. The lid of claim 10 wherein the attachment of the clasp is defined by a living hinge.

12. The lid of claim 1 further comprising a second clasp and a corresponding defined gap in the skirt, the second clasp and gap are spaced from the first mentioned clasp and gap, the second clasp independently pivoting from an open position to an engaged position, the second clasp engaging second gap edges of the second gap in the engaged position and drawing the second edges toward one another to shorten the defined gap and moving at least a portion of the skirt inwardly.

13. The lid of claim 1 wherein the cover portion and skirt are circular in shape.

14. The lid of claim 1 wherein the gap edges are positioned parallel to one another.

15. The lid of claim 14 wherein the gap edges are positioned transverse to the plane of the cover portion.

16. The lid of claim 1 wherein the gap edges of the skirt comprise locking elements thereon, the locking elements formed for engagement with the clasp in the engaged position.

17. The lid of claim 16 wherein the locking elements are formed by at least one projecting tab aligned with the gap edges.

18. The lid of claim 17 wherein the projecting tab comprises a hook thereon for engaging within a slot on an inside surface of the clasp.

19. A lid for a container, comprising:

a cover panel having an outer perimeter;

a skirt depending from and encircling the cover panel, the skirt formed for receiving a rim of an opening into container and to surround and secure the lid to the rim, the skirt having a gap located along its length, and a pair of opposing gap edges are defined on opposite sides of the gap, a flexing portion defining a connection between the cover panel and the skirt, at least a portion of the flexing portion being compliant relative to the surrounding portions to permit structural movement of the skirt relative to the cover panel, and a clasp aligned with the defined gap in the skirt and overlapping the gap edges, the clasp pivotable into an engaged position with the skirt on opposite sides of the gap, in the engaged position the clasp moves the gap edges closer together and moves the skirt inwardly, the flexing portion responding to the inward movement of the skirt and causing movement of the skirt in an axial direction away from the cover panel, the inward and axial movement of the skirt creating engagement with the rim of the container when the lid is positioned thereon.

20. The lid of claim 19 wherein the clasp is hingedly connected the cover panel at a position adjacent the skirt.

21. The lid of claim 19 wherein the flexing portion is formed by a relatively resilient portion of the cover panel positioned at the periphery of the cover panel at the connection with the skirt portion.

22. A combination container and sealable lid comprising:

a container having a plurality of wall portions defining an interior volume for storing a desire material content, and an opening in the wall portions providing access to the interior volume, the opening surrounded by a projecting rim, the rim having an outer wall portion and a peripheral bead projecting therefrom; and a lid for placement on the opening and engagement with the rim, the lid having a cover panel dimensioned to cover at least a portion of the container opening, the cover panel defining an outer perimeter, a skirt attached to and depending from the outer perimeter of the cover panel, the skirt overlapping the outer wall of the rim of the container when the lid is placed on the opening, the skirt having a gap formed between adjacent portions thereof, the gap defined by spaced gap edges, a clasp pivotably attached adjacent the outer perimeter of the cover panel relatively above the gap, the clasp dimensioned to overlap the gap when pivoted towards the skirt, and engagement elements for releaseably securing the clasp to the gap edges in an engaged position of the clasp with the skirt, wherein the clasp upon pivoting into the engaged position overlaps the gap and the engagement elements are secured on the gap edges, the engagement of the clasp with the engagement elements urging the adjacent gap edges towards one another, reducing the length of the gap, and moving the skirt inwardly toward the outer wall of the rim of the container.

23. The container and lid combination of claim 22 wherein the lid further comprises a projection formed along an inside surface of the skirt, the projection positioned to engage the bead on the rim of the container when the lid is positioned on the container opening.

24. The container and lid combination of claim 23 further comprising a flexing portion position at the periphery of the cover panel and connecting the skirt to the cover panel, the flexing portion formed to permit axial movement of the skirt relative to the cover panel.

25. The container and lid combination of claim 24 wherein the urging of the gap edges towards one another by the clasp in the engaged position further causes the axial movement of the skirt, the axial movement of the skirt in the engaged position causing the projection to move under the bead during the inward movement of the skirt.

26. A lid for a container, comprising:

a cover panel having an outer perimeter;

a skirt depending from and encircling the cover panel, the skirt formed for receiving a rim of an opening into container and to surround and secure the lid to the rim; and a flexing portion defining a resilient connection between the periphery of the cover panel and adjacent portions of the skirt, the flexing portion being structurally compliant relative to the surrounding cover panel and skirt portions to permit axial movement of the skirt relative to the cover panel, the flexing portion responding to the axial movement of the skirt relative to the cover panel by an inward movement of the skirt for engagement with the rim of the container.

27. The lid of claim 26, wherein the skirt includes a gap located along its length, the gap defining a pair of opposing gap edges on opposite sides, and further comprising a clasp pivotably connected adjacent the cover panel at a position adjacent the gap, the clasp upon pivoting into an engaged position overlaps the gap and engagement elements secure the clasp on the gap edges, the engagement of the clasp urging the adjacent gap edges towards one another, reducing the length of the gap, and moving the skirt inwardly.

28. The lid of claim 26 wherein the flexing portion is defined by a pair of spaced grooves in the wall of the cover, the grooves creating structural compliance of the flexing portion.

29. The lid of claim 26 wherein the flexing portion is defined by a material that is relatively compliant as compared to the materials of the adjacent skirt and cover portions.

* * * * *